US008795031B1

(12) United States Patent
Wagner

(10) Patent No.: US 8,795,031 B1
(45) Date of Patent: Aug. 5, 2014

(54) APPARATUS AND METHOD FOR REMOVING A PORTION OF MATERIAL FROM THE SURFACE OF A CERAMIC

(75) Inventor: Gerald A. Wagner, Uniontown, PA (US)

(73) Assignee: Saint-Gobain Ceramics & Plastics, Inc., Worcester, MA (US)

( * ) Notice: Subject to any disclaimer, the term of this patent is extended or adjusted under 35 U.S.C. 154(b) by 493 days.

(21) Appl. No.: 13/153,165

(22) Filed: Jun. 3, 2011

Related U.S. Application Data

(60) Provisional application No. 61/396,951, filed on Jun. 4, 2010.

(51) Int. Cl.
*B24B 9/06* (2006.01)

(52) U.S. Cl.
USPC ..... 451/41; 451/259

(58) Field of Classification Search
USPC ..... 451/41, 259, 548, 541, 540
See application file for complete search history.

(56) References Cited

U.S. PATENT DOCUMENTS

| | | | | | |
|---|---|---|---|---|---|
| 650,234 | A | * | 5/1900 | Fitzgerald | 423/345 |
| 1,501,730 | A | * | 7/1924 | Siegel | 451/259 |
| 2,468,404 | A | * | 4/1949 | Miller | 451/67 |
| 2,741,076 | A | * | 4/1956 | Jordan | 451/317 |
| 2,964,823 | A | | 12/1960 | Fredriksson | |
| 3,641,991 | A | * | 2/1972 | Haber | 125/10 |
| 6,753,089 | B2 | | 6/2004 | Bryden | |
| 7,026,039 | B2 | | 4/2006 | Bryden | |
| RE40,301 | E | | 5/2008 | Bryden et al. | |
| 7,452,606 | B2 | | 11/2008 | Bryden | |

* cited by examiner

*Primary Examiner* — Robert Rose
(74) *Attorney, Agent, or Firm* — Robert N. Young; Abel Law Group, LLP

(57) ABSTRACT

An apparatus and method for removing a portion of material from the surface of a ceramic include a table with a rotatable wheel thereon. A pad is disposed on the rotatable wheel such that the pad can remain on the rotatable wheel as the wheel is rotated but is removable from the wheel when not in use. A recrystallized silicon carbide disk is disposed on the pad having sufficient friction to remain on the pad as the wheel and pad are rotated but is removable from the rotatable wheel and pad when not in use.

17 Claims, 1 Drawing Sheet

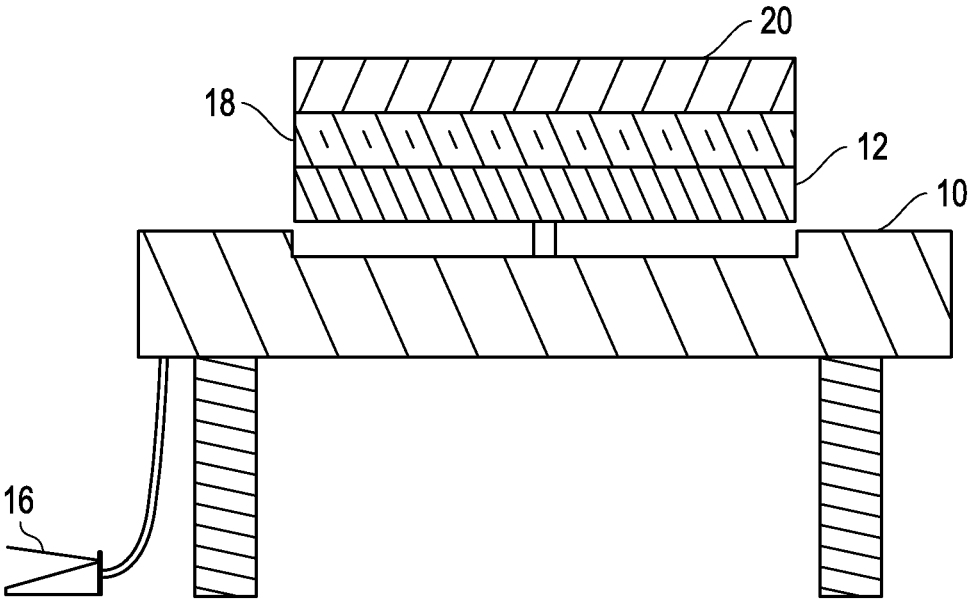
20
18
12
10
16

APPARATUS AND METHOD FOR REMOVING A PORTION OF MATERIAL FROM THE SURFACE OF A CERAMIC

CROSS-REFERENCE TO RELATED APPLICATION(S)

The present application claims priority from U.S. Provisional Patent Application No. 61/396,951, filed Jun. 4, 2010, entitled "APPARATUS AND METHOD FOR REMOVING A PORTION OF MATERIAL FROM THE SURFACE OF A CERAMIC," naming inventor Gerald A. Wagner, which application is incorporated by reference herein in its entirety.

BACKGROUND OF THE INVENTION

Fired pottery and other ceramics can have imperfections on its surfaces, such as bumps or glaze that runs onto unwanted surface areas. Presently it is difficult to remove the bumps or glazing with a high-speed rotary tool such as from the Dremel Company. This tool has a bonded grinding wheel that can damage the surface of the pottery as it is removing the glazing. Operating a bonded grinding wheel at a slow rotational speed can provide unsatisfactory results. Further, there are safety concerns with the use a high-speed, hand-held rotary tool.

Therefore, a new apparatus and method is needed to provide improved removal of product from pottery and other ceramics.

SUMMARY OF THE INVENTION

An apparatus for removing a portion of material from the surface of a ceramic includes a table with a rotatable wheel thereon. A pad is disposed on the rotatable wheel such that the pad can remain on the rotatable wheel as the wheel is rotated but is removable from the wheel when not in use. A recrystallized silicon carbide disk is disposed on the pad having sufficient friction to remain on the pad as the wheel and pad are rotated but is removable from the rotatable wheel and pad when not in use.

A method for removing a portion of material from the surface of a ceramic includes placing on a table with a rotatable wheel a pad on the rotatable wheel such that the pad can remain on the rotatable wheel as the wheel is rotated but is removable from the wheel when not in use. Placed on the pad is a recrystallized silicon carbide disk having sufficient friction to remain on the pad as the wheel and pad are rotated but is removable from the wheel and pad when not in use. The recrystallized silicon carbide disk is rotated. A ceramic, such as pottery piece having glazing, is applied to the recrystallized silicon carbide disk with sufficient force to remove at least a portion of the material as the recrystallized silicon carbide disk is rotated, thereby removing a portion of material from the surface of a ceramic.

The disclosed invention has many advantages. One advantage is that the recrystallized silicon carbide provides a low speed alternate. Another advantage includes the ease of changing the recrystallized disc. Since the disc is operated at such a low speed it is not necessary to attach the disc to the wheel.

BRIEF DESCRIPTION OF THE DRAWINGS

FIG. 1 is a schematic representation of an apparatus for grinding the glazing off of a pottery surface.

DETAILED DESCRIPTION OF THE INVENTION

A pottery wheel is a spinning round table. There is a splash pan that is disposed around the wheel to catch water and clay as it spins. Pottery wheels are available in electric or manual versions and many different sizes. One can purchase a one-speed small plastic wheel to very expensive adjustable speed wheels for professionals. Many have attached seats so that one knows one is seated sitting at the right level. These wheels are used to make many different pottery pieces such as bowls, flower pots and urns.

The most common type of pottery wheel these days is electric. It comes with a foot pedal that turns the wheel faster when pressure is placed on it. The wheel is placed in a frame and is about waist high. The user can sit in front of the wheel and lean forward to work with the potter glazing. The wheel turns non-stop as long as there is pressure on the foot pedal. As it is turning, the user can position the pottery piece to apply with force to the wheel. Each step in making the piece will require a certain speed for the wheel to turn. The pottery wheel is rotated relatively slowly, such as 60-120 rpm, to avoid excessively stressing the pottery.

Manual wheels work the same way, except the rotation speed is controlled by the potter himself. There is a separate fly wheel at the bottom of the frame that the potter moves with his feet. The faster he needs the pottery wheel to turn, the faster he must move his feet. There are still potters today that use this method, and manual pottery wheels are still being manufactured.

In one embodiment the pottery table 10 has a pottery wheel 12 that can be rotated thereon by a suitable means such as an electric motor. The speed of rotation can be controlled by a foot pedal 16. Disposed on the pottery wheel is a pad 18 that can include a piece of foam carpet padding, rubber or plastic matting. The pad is intended to provide cushioning between the wheel and silicon carbide disc.

The silicon carbide disc 20 is typically round with flat surfaces. In one embodiment, the disc is fourteen inches in diameter and five sixteenth of an inch in thickness. However, other widths and thicknesses can be used.

Another application includes using a recrystallized silicon carbide bar as a handheld buffer polisher. In one embodiment, the dimensions of a bar are about 1.5 inches by about 1.5 inches by about six inches. The bar can be hollow to make it lighter and easier to handle and use. Further it can be sized as desired.

One suitable material is recrystallized silicon carbide (SiC), available from Saint-Gobain Ceramics & Plastics, Inc. of Worcester, Mass., under the trademark CRYSTAR®. A process for forming recrystallized silicon carbide articles is disclosed in U.S. Pat. No. 2,964,823, the teachings of which are incorporated herein by reference. It has robust mechanical properties through a wide range of temperatures and purity characteristics. CRYSTAR® ceramic has suitable characteristics for grinding pottery including that it does not contaminate or mark the surface of the pottery as do conventional bonded grinding wheels.

Other examples of suitable materials include CRYSTAR® RB which is a reaction-bonded silicon carbide (SiSiC) that is fine grained and impregnated with silicon metal. Advanced Nitride Bonded Silicon Carbide (NSiC) is another composition that can be suitable. It is formed from a green body that includes silicon powder and the Si3N4 bond is formed in-situ by firing the body at high temperature in a nitrogen atmosphere. It is marketed as ADVANCER® by Saint-Gobain Ceramics & Plastics, Inc. NSiC has almost twice the strength of ReSiC and includes the NSiC product lines of ADVANCER®, AnnaSicon® RT, and AnnaSicon® RTH to be selected according to the considered service condition. The manufacturing process includes shaping the parts by slip casting and firing the green body at a very high temperature in a protective atmosphere. The methods for forming silicon carbide are disclosed in U.S. Pat. Nos. 6,753,089, 7,026,039, RE40301 and 7,452,606, the teachings of which are incorporated herein by reference.

EQUIVALENTS

From the foregoing detailed description of the specific embodiments of the invention, it should be apparent that a novel apparatus has been described. Although particular embodiments have been disclosed herein in detail, this has been done by way of example for purposes of illustration only, and is not intended to be limiting with respect to the scope of the appended claims which follow. In particular, it is contemplated by the inventors that various substitutions, alterations, and modifications may be made to the invention without departing from the spirit and scope of the invention as defined by the claims.

The invention claimed is:

1. A method for removing a portion of material from the surface of a ceramic, comprising the steps of:

a) placing on a table with a rotatable wheel a pad on said rotatable wheel such that the pad can remain on said rotatable wheel as the wheel is rotated but is removable from said wheel when not in use;

b) placing on the said pad a recrystallized silicon carbide disk having sufficient friction to remain on said pad as the wheel and pad are rotated but is removable from said wheel and pad when not in use;

c) rotating said recrystallized silicon carbide disk; and d) applying a ceramic to said recrystallized silicon carbide disk with sufficient force to remove at least a portion of said material as said recrystallized silicon carbide disk is rotated, thereby removing a portion of material from the surface of a ceramic.

2. The method of claim 1 wherein the ceramic includes pottery.

3. The method of claim 1 wherein the recrystallized silicon carbide disk has a diameter of about 14 inches.

4. The method of claim 1 wherein the recrystallized silicon carbide disk has a thickness of about 5/16 inches.

5. The method of claim 1 wherein the pad includes a carpet material.

6. The method of claim 1 wherein rotating is performed at a rotational velocity in a range of 60 rpm to 120 rpm.

7. The method of claim 1 further comprising:

e) removing the pad from the rotatable wheel after applying the ceramic to the recrystallized silicon carbide disk.

8. An apparatus for removing a portion of material from the surface of a ceramic, comprising:

a) a table with a rotatable wheel thereon;

b) a pad disposed on said rotatable wheel such that the pad can remain on said rotatable wheel as the wheel is rotated but is removable from said wheel when not in use; and c) a recrystallized silicon carbide disk disposed on said pad having sufficient friction to remain on said pad as the wheel and pad are rotated but is removable from said wheel and pad when not in use.

9. The apparatus of claim 8 wherein the ceramic includes pottery.

10. The apparatus of claim 8 wherein the recrystallized silicon carbide disk has a diameter of about 14 inches.

11. The apparatus of claim 8 wherein the recrystallized silicon carbide disk has a thickness of about 5/16 inches.

12. The apparatus of claim 8 wherein the pad includes a carpet material.

13. The apparatus of claim 8 wherein the rotatable wheel is an electric version.

14. The apparatus of claim 8 wherein the rotatable wheel is a manual version.

15. The apparatus of claim 8 wherein the recrystallized silicon carbide disk is impregnated with silicon metal.

16. The apparatus of claim 8 wherein recrystallized silicon carbide disk comprises a nitride bonded silicon carbide.

17. The apparatus of claim 8 wherein the pad comprises a rubber or plastic matting.

* * * * *